United States Patent [19]

Waite

[11] 4,019,739

[45] Apr. 26, 1977

[54] SHOVEL GAME

[76] Inventor: Eric L. Waite, 14808 Clark St., Van Nuys, Calif. 91401

[22] Filed: Sept. 10, 1975

[21] Appl. No.: 611,924

Related U.S. Application Data

[63] Continuation-in-part of Ser. No. 507,332, Sept. 19, 1974, abandoned.

[52] U.S. Cl. ..... 273/95 D; 273/3 C; 273/67 R; 273/105 R; 273/123 R; 273/127 B; 273/129 B; 273/180

[51] Int. Cl.[2] ..... A63B 63/00

[58] Field of Search ..... 273/2, 3 C, 12, 85 E, 273/67 R, 95 R, 95 D, 101, 102 R, 105 R, 113, 115, 118 R, 123 R, 127 R, 127 B, 129 R, 129 B, 129 HB, 176 F, 176 FA, 176 FB, 178 R, 178 A, 178 B, 179 R, 179 A, 179 B, 179 C, 179 D, 179 E, 180, 95 F; 108/51

[56] References Cited

UNITED STATES PATENTS

| | | | |
|---|---|---|---|
| 607,020 | 7/1898 | Dodge | 273/127 B |
| 617,562 | 1/1899 | Clark | 273/123 R |
| 935,585 | 9/1909 | Campbell | 273/85 E |
| 1,136,153 | 4/1915 | Martineau et al. | 273/123 R |
| 2,326,859 | 8/1943 | Hoover | 273/123 R X |
| 2,443,759 | 6/1948 | Anderson | 273/179 A |
| 2,468,979 | 5/1949 | Howard | 273/127 R |
| 2,826,417 | 3/1958 | Marcoccio | 273/67 R X |
| 3,070,372 | 12/1962 | Brinati et al. | 273/178 R |
| 3,097,849 | 7/1963 | Rice | 273/180 |
| 3,341,207 | 9/1967 | Shusda | 273/178 A |
| 3,511,191 | 5/1970 | Barry, Jr. et al. | 108/51 X |

FOREIGN PATENTS OR APPLICATIONS

| | | | |
|---|---|---|---|
| 117,587 | 11/1926 | Switzerland | 273/127 B |
| 6,596 | 12/1907 | United Kingdom | 273/123 R |
| 586,055 | 3/1947 | United Kingdom | 273/123 R |

*Primary Examiner*—Richard T. Stouffer

[57] ABSTRACT

A game which employs a rectangular horizontal board including a plurality of scoring openings formed therein in a particular pattern. Each of the openings are circular and of the same diameter. The diameter of each opening being in exact relation to the diameter of the playing ball. Surrounding each opening is a slightly recessed or depressed area in order to encourage movement of a playing object into contact with that opening. The playing objects will comprise a plurality of balls which are substantially larger in size than the openings. The playing surface is surrounded on three sides by a sidewall and on the fourth side an inclined ramp is located. The ball playing objects are to be moved up over the ramp and onto the playing surface. The ramp is to be reversible so as to facilitate playing of the game of this invention on both a carpeted surface and a hard surface. Additionally, the ramp has two variously disposed kick bars, one on each side, to cause one of the balls, when moved with sufficient velocity over the ramp, to be propelled through the air onto the playing surface. A scoop which is connected to a handle is to be employed to effect movement of the ball across a floor and up over the ramp and onto the playing surface.

5 Claims, 10 Drawing Figures

SHOVEL GAME

REFERENCE TO PRIOR APPLICATION

This application is a Continuation-In-Part application of patent application Ser. No. 507,332 filed Sept. 19, 1974 entitled SHOVEL GAME, by the present inventor and now abandoned.

BACKGROUND OF THE INVENTION

The field of this invention relates to a game and more particularly to a shuffle board type game which is competitive between two or more players and holds the interest of two or more players even when the players are adults playing against children. The game is designed with a combination of chance and skill.

A substantial number of games of the prior art are composed of a substantial number of parts and do not facilitate portability. Also, many games of the prior art are quite bulky in size. An additional disadvantage of many games of the prior art is that the games employ essentially all chance and skill. Once skill is minimized or non-existant the game will quickly lose its challenge to persons playing the game. Another disadvantage of games of the prior art is that they are quite costly to manufacture.

SUMMARY OF THE INVENTION

The description of the structure of this invention is believed to be adequately described in the Abstract Of The Disclosure and reference is to be had thereto.

A primary objective of the game of this invention is to design a game that combines chance and skill and that holds interest and is challenging and competitive for adults when playing against each other, children when playing against each other, or adults and children when playing as opponents.

A further object of this invention is to design a game in which the element of chance can equalize the advantage of skill thereby giving children an equal opportunity to win when playing with adults and maintaining the important interest factor.

A further object is for persons playing this game to receive athletic activity indoors equivalent to playing the conventional outdoors shuffleboard game.

A further objective is to design a game which is composed of few parts and can be readily transported from place to place.

A further advantage of this invention is that the game can be constructed quite inexpensively and therefore the cost of purchase of the game is minimized.

The game of this invention has been found to be an exciting game of both luck and skill.

DETAILED DESCRIPTION OF THE SHOWN EMBODIMENT

Figure 1:
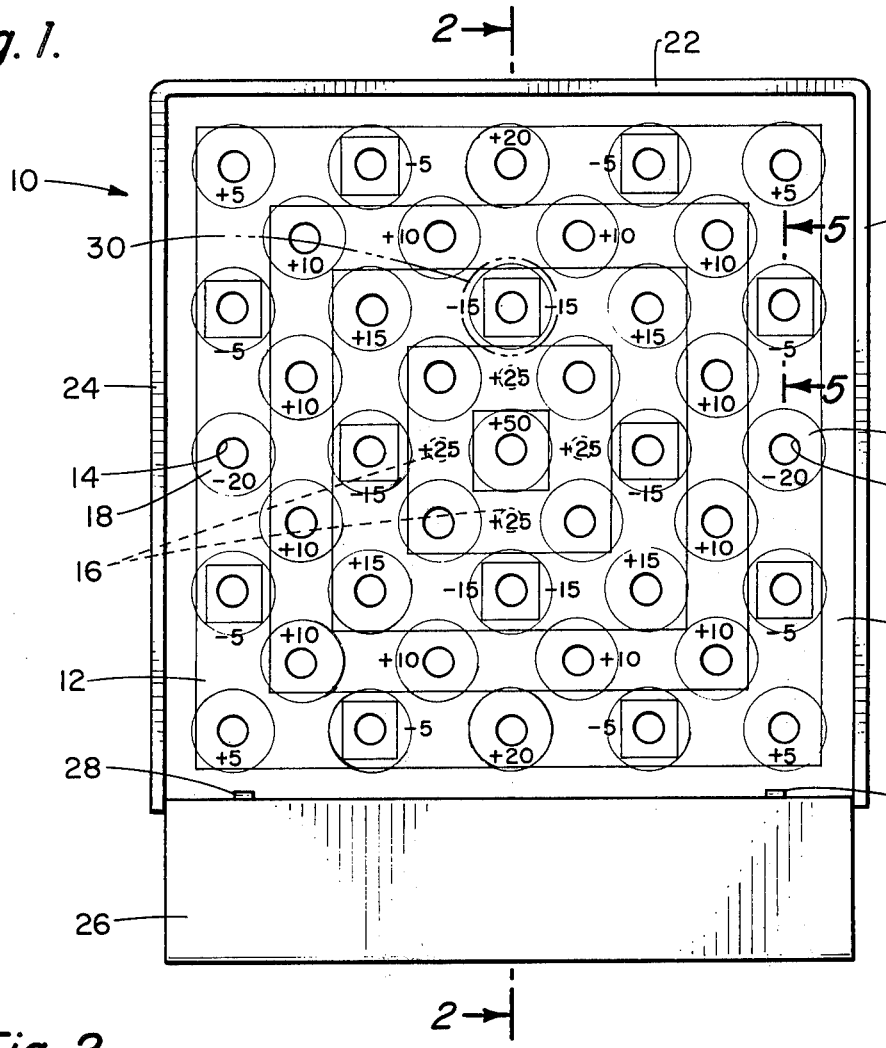
FIG. 1 is a plan view of the playing surface of the game of this invention.
Figure 5:
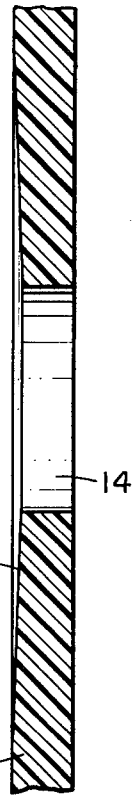
FIG. 5 is a cross-sectional view through a portion of the playing surface taken along line 5—5 of FIG. 1.

Referring particularly to the drawing, there is shown the game of this invention which includes the use of a playing board 10. The playing board 10 is composed of a flat planar base 12 which has formed therein a plurality of scoring apertures 14. The base 12 can be formed of any sheet rigid material, such as wood, plastic, pressed board, or other types of material. The scoring apertures 14 are arranged in a particular, selected pattern within the base 12. It is to be noted that there are 41 of scoring apertures 14. However, the number and the placement of the scoring aperture 14 can be varied without departing from the scope of this invention.

Each of the scoring apertures 14 are of the same diameter. In actual practice, it has been found that the preferable diameter is thirteen-sixteenths of an inch. The board 12 is formed in a square configuration with each side of the square being eighteen inches.

Attached to the bottom surface of the base 12 are a plurality of feet 16. The feet 16 are located substantially adjacent the center of the base 12 and are to come into contact with the floor or other surface upon which the board 10 is to rest. As will be explained further on in the specification, the base 12 will be spaced slightly from the floor and the purpose of the feet 16 is to prevent bowing of the base 12.

Included within the base 12 surrounding each scoring aperture 14 is a beveled or depressed area 18. Each depressed area is 2 inches in diameter and concentrically surrounds each scoring aperture 14. The depressed area is approximately fourth-thousandths of an inch deep and the function of the depressed area will be explained further on in the specification.

The base 12 is connected to a side means which is composed of side panels 20, 22 and 24. The side panels 20, 22 and 24 basically encase the base 12 on three sides thereof. The base 12 is mounted within grooves formed within the side panels 20, 22 and 24. The side panels 20, 22 and 24 are to be located substantially perpendicular with respect to the base 12 and extends vertically therefrom. The purpose of the side panels 20, 22 and 24 is to prevent the playing objects from becoming accidentally dislodged from the base 12. Side panels 20, 22 and 24 can be formed of wood, plastic or other type of rigid material and will normally be connected together at the ends thereof, of can comprise an integral unit. Also, it is to be understood that the base 12 could be mounted with respect to the side panels 20, 22 and 24 other than by means of a groove arrangement and may be located directly upon a ledge formed within the side panels.

It is readily apparent from the foregoing that there is an open side of the base 12 which functions as an access opening of the playing surface. An attaching panel 25 is interconnected between the side panels 20 and 24 and also includes a groove therein which connects with the base 12. A ramp 26 is to be mounted upon the attaching panel 25 by means of a pair of spaced apart, frictionally engaging clamps 28. The outer end of the ramp 26 is to rest against the floor or other supporting surface upon which the game of this invention is to be played. The ramp 26 is inclined with the upper end of the ramp being located a short distance above the playing surface of the base 12. It has been found to be preferable that this distance should be about thirteen-sixteenths of an inch. One function of this spacing is to prevent a playing object from becoming removed from the board once it has been located upon the playing surface.

The normal type of playing object will be a ball 30. The diameter of the ball will be about two and one-eighth inches. The height of the ramp from the playing surface of the base 12 is also selected so that when the ball 30 is moved across the ramp 26 that the ball will be capable of becoming lodged in only one of the rows of scoring openings. 14.

The ball 30 is to be propelled across the ramp 26 by means of a scoop 32. The scoop 32 is connected to a handle 34. The handle 34 is to be grasped by a player and to propel a ball 30 which has been located within the scoop 32. The handle 34 is formed of a fixed section 36 and a removable section 38 in order to permit the handle to be disassembled to facilitate storage.

Figure 2:
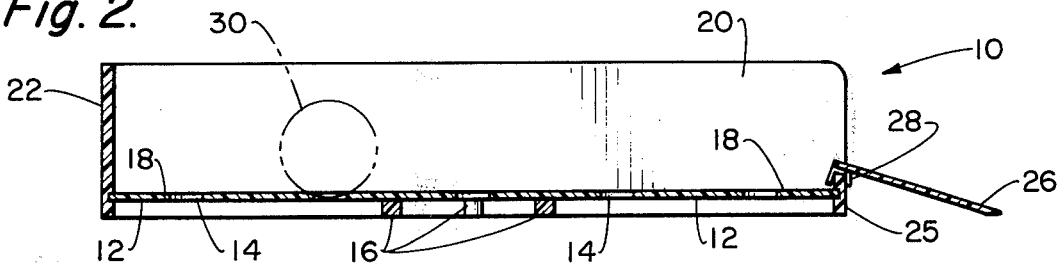
FIG. 2 is a cross-sectional view taken along line 2—2 of FIG. 1.
Figure 3:
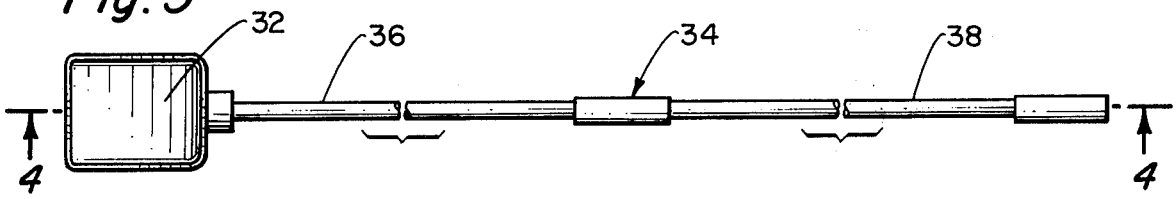
FIG. 3 is a plan view of the scoop employed to move the playing objects onto the playing surface.
Figure 4:
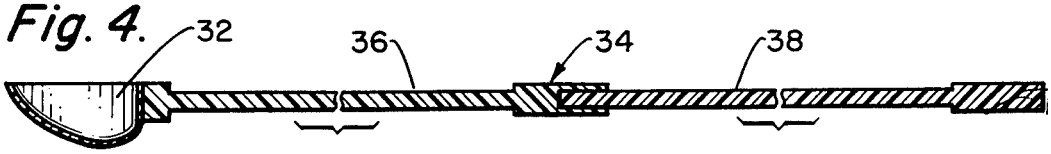
FIG. 4 is a cross-sectional view taken along line 4—4 of FIG. 3.
Figure 6:
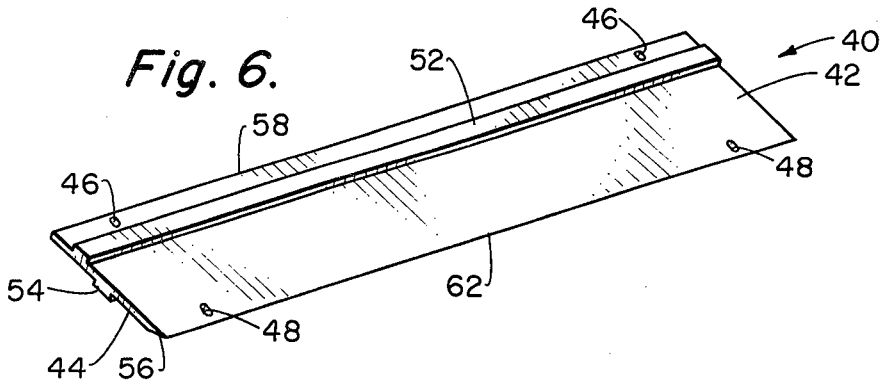
FIG. 6 is an isometric view of the reversible ramp which is a modification of the ramp employed within FIGS. 1 to 5.

The rules of play of the game of this invention are as follows: two or four players can play the game of this invention. With the playing surface 10 placed upon a floor, the ramp 26 is placed in position across the access opening as shown in FIGS. 1 and 2. The clamps 28 are in frictional contact with the attaching panel 25. The scoops 32, there are two in number are assembled with the handle member 38 being connected to handle member 36. The players should be located approximately ten to twelve feet from the playing surface of the base 12 when propelling a ball 30. The farther the players stand from the playing surface, the more skill of the game that is required. A ball is placed in the scoop 32 and the ball is propelled along the floor with a long, straight forward follow-through motion causing the ball to move across the ramp 26 upon the playing surface. The board 12 must be level for accurate play. If your opponent's ball goes into the high-scoring opening 14, the next player should shoot his ball to "knock-out" the opponent's ball from the high-scoring opening. Or if your own ball is in a high-scoring minus opening, you would want to shoot to remove this ball so it can come to rest within another opening, hopefully a positive scoring opening.

A single frame consists of all eight balls being played. The loser of a coin toss shoots the first ball of the first frame. Thereafter, player of team scoring the most points in each frame must shoot first, thus giving the opponent the advantage of shooting the last ball which can change the entire scoring situation. When two players are playing, each player uses three balls of the same color and a bonus ball and shoots them alternately. When four players are playing (two teams), each team uses three balls of the same color and a bonus ball and players from each team shoot alternately. The bonus ball, there is only one for each team, can be used for the first, second, third or last shot at the player's discretion. When the bonus ball comes to rest within any scoring opening, the score of that opening is doubled. Straight or diagonal shots can be made from any position within the width of the target area. Balls not entering or bouncing out of the target area are removed and cannot be replayed until the next frame.

It is noted in the drawing that the scoring varies from −20 to +50 points. Keep in mind that any one of these scores can be doubled by causing a bonus ball to come to rest within one of these particular scoring areas. The first player or team to get one hundred and fifty points wins the game, with the best two out of three games winning a series. A penalty of 50 points is awarded if a player shoots his last ball deliberately in order to miss the target area to avoid hitting his own ball which is placed within a higher scoring opening.

The size of each of the openings 14 as compared to the size of the ball 30 is so the ball 30 will be merely resting within the opening and be easily dislodged by being struck by an opponent's ball which may change the entire scoring. Actually, just a nudge by one ball against another ball will cause removal of the second ball from its scoring opening due to the slight depth of area 18 and the small opening size 14 as compared to the large size of ball 30. A single ball passing between two balls located in adjacent openings 14 will cause removal of both balls located in these openings 14. The dislodged balls can, in turn, dislodge other balls or may move to rest within other scoring openings. The depth of area 18 is selected so as to not hinder this dislodging movement but yet slightly encourage a ball to rest within an opening.

The ramp angle is selected so the ball can be propelled slowly to drop in a front scoring opening or can be propelled faster to "hop" over any balls in the front scoring openings and bounce off the side panel 22 and enter the scoring area from the rear. This can permit a player to not dislodge one of his own balls located in a high-scoring opening 14 while giving to the player an opportunity to place another ball hopefully within another high-scoring opening. The ramp angle is selected in consideration of the opening size and the depth of area 18 and any change of ramp angle changes the opening size and depth of area 18. The ramp angle, scoring opening size and depth of area 18 are vital parts of this invention.

A modified form of the ramp 26 is shown in FIGS. 6 through 10. This ramp 40 is to be used in conjunction with the base 12 and both sides 42 and 44 of the ramp 40 are capable of being employed during the playing of the game. The side 42 is designed to be used upon a hard surface with the side 44 being designed to be used on a carpeted surface.

The ramp 40, at one end, includes a pair of space apart openings 46 and at the opposite end of the ramp 40 is a second pair of spaced apart openings 48. Included upon the attaching panel 24 are a pair of spaced apart protuberances 50. The protuberances 50 are capable of cooperating within the openings 46 or the openings 48.

Integrally formed upon the surface 42 is a longitudinal kick bar 52. The kick bar 52 is located directly adjacent openings 46. In other words, the bar 52 is much nearer the end of the ramp that contains the openings 46 than the other end of the ramp.

Formed upon the surface 44 is a longitudinal kick bar 54. The kick bar 54 is positioned substantially in the middle of the ramp and is about equidistantly spaced between the openings 46 and 48.

Figure 7:
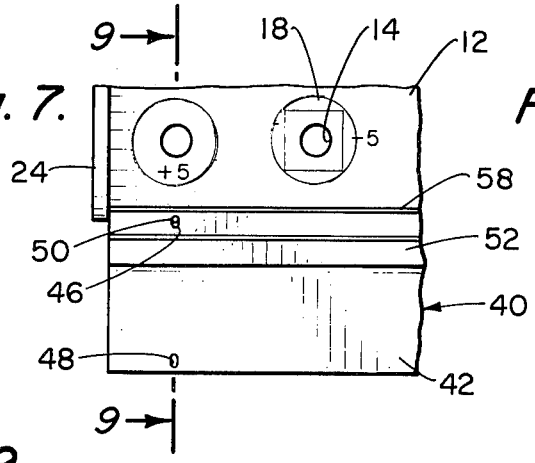
FIG. 7 is a partial plan view of the ramp of this invention showing the ramp located upon a hard surface.
Figure 9:
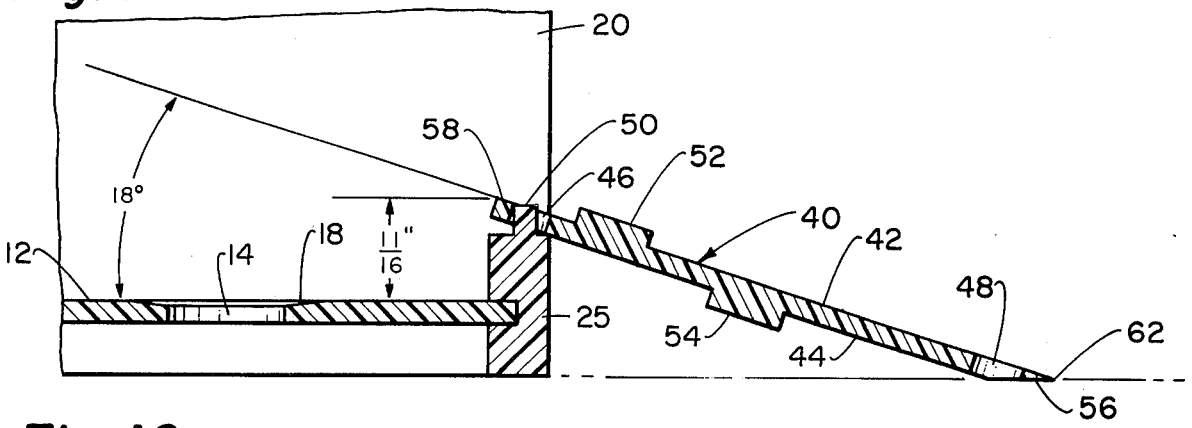
FIG. 9 is a cross-sectional view taken along line 9—9 of FIG. 7.

When it is desired to play the game of this invention upon a hard surface, such as a hard wood or linoleum floor, the surface 42 is designed to be used and the ramp 40 is placed as shown in FIGS. 7 and 9 of the drawings. The lower end of the ramp 40, when in this position, is formed to include a bevel 56 which permits this lower end of the ramp to be placed flat on the floor. When in this position, the protuberances 50 rest within the openings 46. A ball, as it is rolled from the floor and in contact with the ramp 40, will roll smoothly up the surface 42 and in contact with the kick bar 52. The function of the kick bar 52 is as follows. If the ball is rolled slowly, the ball will merely move over the kick bar and fall in an area very close to the attaching panel 24 as it comes in contact with the base 12. This will permit the ball to possibly come into contact with the first series of openings 14 and also is capable of knocking any ball positioned within this first series of openings. If the ball is rolled at a greater velocity, the kick bar 52 will function to cause the ball to be propelled through the air over the first row of openings 14 thereby not disturbing any ball which may be located in such openings. At a still greater velocity, the ball may be propelled over two or more rows of openings 14.

It has been found to be preferable to locate the kick bar 52 directly adjacent the openings 46. If the kick bar 52 is positioned further back, it has been found to be more difficult to propel the ball at different velocities with a sufficient degree of accuracy so as to propel the ball selectively over a single row or the first row of openings 14 or over several rows of openings 14.

Further it has been found to be desirable to have the edge 58 of the ramp be located a height of eleven-sixteenths of an inch above the surface of the base 12. This distance must be held to be very precise because if the ramp is located even an eighth of an inch below this value of eleven-sixteenths of an inch or an eighth of an inch above eleven-sixteenths of an inch the overall nature of the game will be drastically changed. Also, a preferable value of eighteen degrees inclination of the ramp 40 is most preferable with the ramp located in the position shown in FIG. 9.

Figure 8:
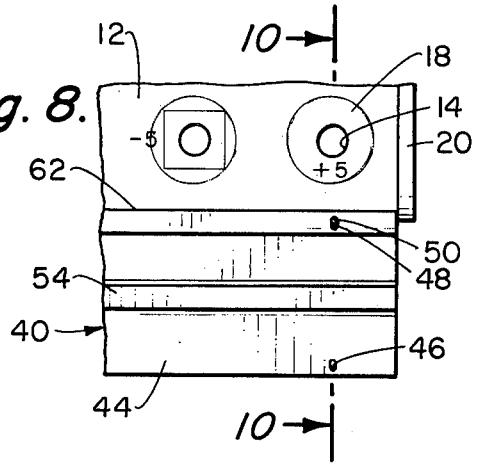
FIG. 8 is a partial plan view of the ramp of this invention showing the ramp in position to be played upon a carpeted surface.
Figure 10:
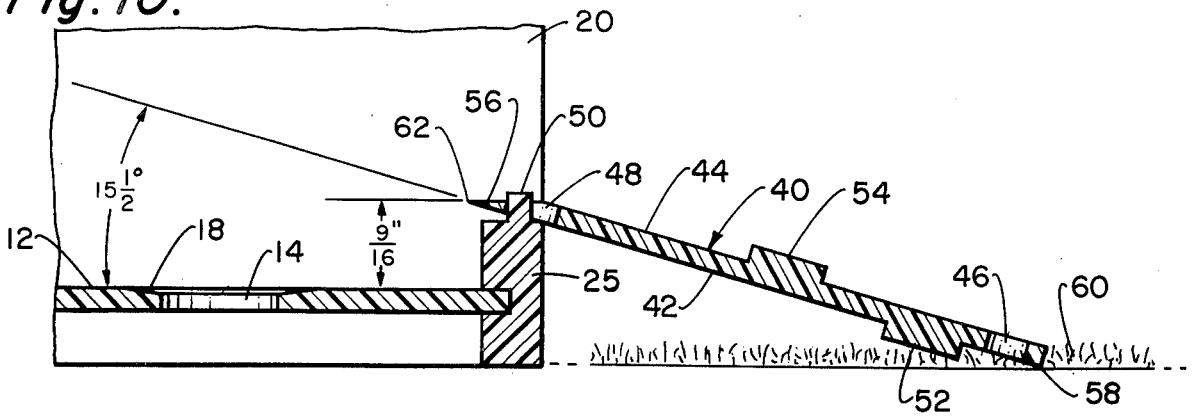
FIG. 10 is a cross-sectional view taken along line 10—10 of FIG. 8.

Referring particularly to FIGS. 8 and 10, the reverse side or side 44 of the ramp 40 is shown being used. The edge 58 is in contact with a carpet 60 and the ball will be designed to roll over the tufted carpet 60 and upon the surface 44 of the ramp 40. The ball is designed to come into contact with the kick bar 54. Because the angle of inclination of the ramp is less (15½° as opposed to 18°) and the fact that the edge 62 of the ramp is positioned only nine-sixteenths of an inch above the playing surface of the base 12, the kick bar 54 is located more near the center of the ramp 40. Again, the location of the kick bar 54, in this position, is definitely preferred since it has been found by experimentation that if the kick bar were located in another position that it would be difficult to pre-select the required velocity necessary to either cause the ball to be propelled over one or more rows of openings 14 or not to be propelled at all over any row of openings 14. With the ramp 40 in the position shown in FIG. 10, the openings 48 cooperate with the protuberances 50.

What is claimed is:

1. A game to be placed upon a floor comprising:

a horizontal polygonal shaped base having a plurality of identically sized scoring openings arranged in a particularly selected pattern, said base being located upon said floor and spaced thereabove;

side means connected to the periphery of said base, said side means extending substantially vertically;

an access opening formed within said side means;

a ramp connected by connecting means to said base and positioned within said access opening, said ramp being inclined in respect to said base, one end of said ramp contacting said floor, the other end of said ramp located a spaced distance above said base, the spacing of said ramp above said base being constant, the forward edge of said ramp being a straight line;

a plurality of separate balls to be moved over said ramp upon said base and in contact with said scoring openings, each said ball being substantially larger in diameter than each said opening, each of said openings being circular;

said ramp being reversible with said ramp having a first ball propelling surface and a second ball propelling surface located on opposite sides of said ramp, said first ball propelling surface adapted to receive balls that are moved across a hard surface and said second ball propelling surface adapted to receive balls that are moved across a carpeted surface;

a first kick bar depending from said first propelling surface substantially adjacent an end of said ramp, said first kick bar extending substantially the entire width of said ramp;

a second kick bar depending from said second propelling surface, said second kick bar being positioned substantially at the longitudinal center of said ramp and extending substantially the entire width of said ramp; and a scoop adapted to receive a single said ball, said scoop being attached to a handle, said scoop to be manually moved across the floor to release the retained ball and propel such over said ramp and onto said base.

2. The game as defined in claim 1 wherein:

one edge of said ramp being beveled so as to be capable of resting flat upon a hard surface.

3. The game as defined in claim 2 wherein:

a depressed area located around each of said scoring openings, whereby once a ball comes into close proximity to a said opening the depressed area functions to move the ball into contact with the opening.

4. The game as defined in claim 3 wherein:

said base including a plurality of supportive feet attached to the underside of said base, said feet positioned directly adjacent the center of said base, said feet to contact said floor and prevent said base from bowing.

5. The game as defined in claim 4 wherein:

said particular pattern comprises a plurality of square shaped separate patterns, each said separate pattern comprising a plurality of said scoring openings arranged in an evenly spaced apart manner, said separate patterns being evenly spaced apart with one pattern being inside another.

* * * * *